US005174061A

United States Patent [19]

Dambricourt

[11] Patent Number: 5,174,061

[45] Date of Patent: Dec. 29, 1992

[54] POT COVER CONTAINER-ENVELOPE COMBINATION

[75] Inventor: Gery B. M. C. Dambricourt, Riom, France

[73] Assignee: Compagnie e'tudes et Plastiques, Thiers, France

[21] Appl. No.: 575,701

[22] Filed: Aug. 31, 1990

[30] Foreign Application Priority Data

Aug. 31, 1989 [FR] France ..... 89 11442

[51] Int. Cl.[5] ..... A01G 9/02

[52] U.S. Cl. ..... 47/72; 47/75

[58] Field of Search ..... 47/75, 72, 71, 79, 80, 47/81

[56] References Cited

U.S. PATENT DOCUMENTS

| | | | |
|---|---|---|---|
| 2,246,490 | 6/1941 | Flues | 47/80 |
| 4,040,207 | 8/1977 | Lancaster | 47/80 |
| 4,083,147 | 4/1978 | Garrick | 47/80 |

FOREIGN PATENT DOCUMENTS

| | | | |
|---|---|---|---|
| 190721 | 8/1956 | Austria | 47/72 |
| 2139925 | 2/1971 | Fed. Rep. of Germany | 47/80 |
| 2142234 | 1/1973 | France | 47/80 |
| 2171582 | 9/1986 | United Kingdom | 47/80 |

*Primary Examiner*—Henry E. Raduazo

*Attorney, Agent, or Firm*—Browdy and Neimark

[57] ABSTRACT

In the pot cover container-envelope combination for the presentation of cultivated plants, a container or pot in which the plant has been cultivated is placed inside an envelope and a means is provided for preventing any accidental disengagement of the container or pot from the envelope.

7 Claims, 1 Drawing Sheet

POT COVER CONTAINER-ENVELOPE COMBINATION

FIELD OF THE INVENTION

The present invention relates to a pot cover container-envelope combination for presentation of cultivated plants.

BACKGROUND OF THE INVENTION

It is well known to cultivate plants, flowers and shrubs in plastics material containers or pots in which these plants, flowers and shrubs grow, sometimes for several years.

During the growth of the plants, the pots are subjected to various aggressions which make that their outer appearance is dirty and little aesthetic.

A present marketing method of plants, flowers or shrubs which is used more and more directly with the general public is the cause of a double problem which is the preservation and presentation of the plant during all the period running from the end of the cultivation phase to the sale to the final consumer. Moreover, it is important for the buyer to take away the plant, flower or shrub without getting dirty and without fouling the vehicle which most often is used for the transporation.

OBJECT AND SUMMARY OF THE INVENTION

While keeping the cultivation container or pot even it has been somewhat deformed, the invention provides a new combination enabling a presentation of the plant, flower or shrub in an attractive way in a new product forming with the pot of origin an indissociable assembly whatever the way the plant is being handled.

The object of the invention contributes also to maintaining the plant in a good state of health during all the period following the cultivation phase and preceding the sale, and this without using particular extra fittings.

The invention permits obtaining the hereabove result by using very simple and little costly means, while making that these means thereafter increase the rigidity of the container or pot.

According to the invention, the pot cover container combination for the presentation of cultivated plants is characterized in that a container or pot in which the plant has been cultivated is placed in an envelope, and in that means are provided for preventing any accidental disengagement of said container from the envelope.

Various other features of the invention are moreover more apparent from the following detailed description.

BRIEF DESCRIPTION OF THE DRAWINGS

An embodiment of the invention is shown, by way of a non limiting example, in the accompanying drawings wherein.

FIG. 1 shows a container or pot 1 of the type of those which are used for planting and cultivating various plants;

DESCRIPTION OF PREFERRED EMBODIMENTS

Figure 1:
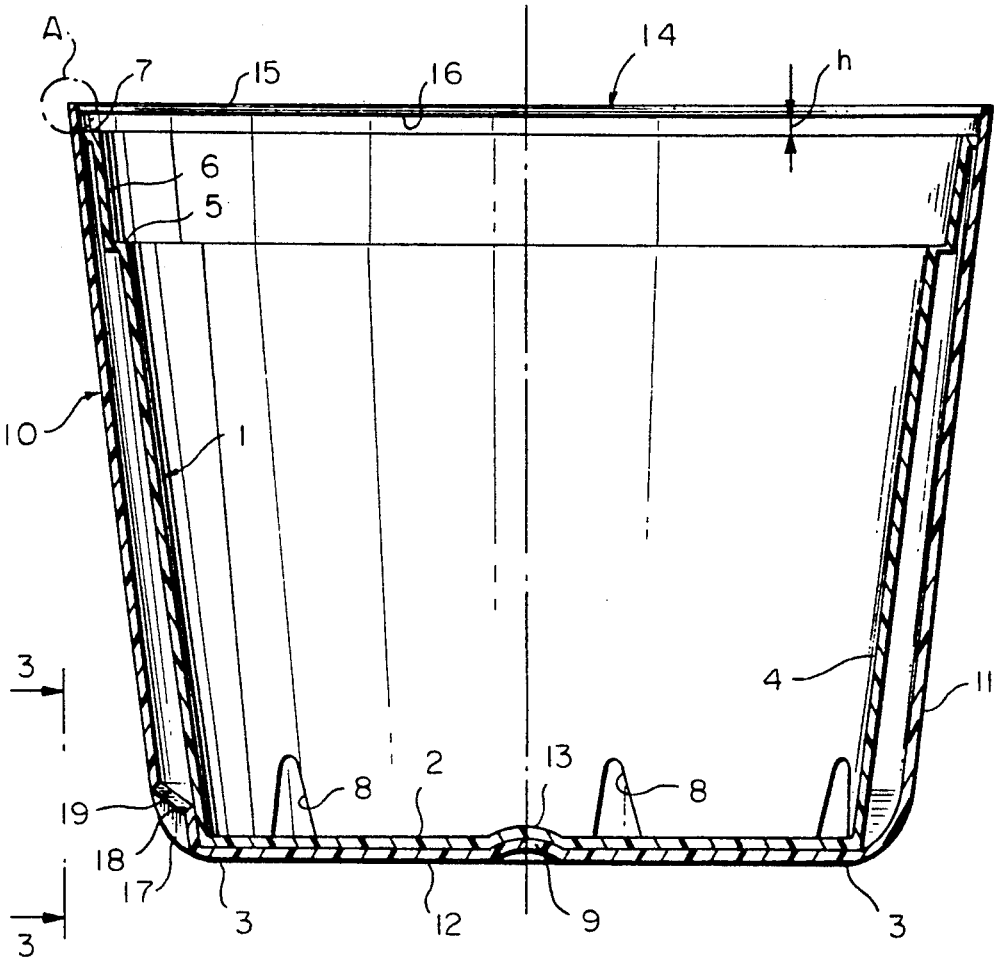
FIG. 1 is a transverse elevation cross-sectional view of the pot cover container combination, subject matter of the invention.

Referring now to the drawings the container comprises a bottom 2 having advantageously support legs 3. The bottom 2 is extended by a frustoconical side wall 4 forming at its upper portion a shoulder 5 from the periphery of which extends a frustoconical ring 6 ending into a protruding flange 7 or other stiffening means. The side wall 4 is formed, near the bottom 2, with drainage openings 8.

It is advantageous, as shown in the drawings, that the bottom 2 is formed with a central protrusion 9 corresponding as such to the injection sprue of the plastics material forming the container.

On the other hand, the combination comprises an envelope 10 forming a pot cover and which is advantageously of a frustoconical shape, meaning that its side wall 11 is preferably parallel or substantially parallel to the frustoconical side wall 4 of the container or pot 1.

However, the conicity angle of the envelope 10 can be different from that of the container side wall according to whether the space separating the container from the envelope has to be greater or smaller.

The outer face of the side wall of the envelope 10 is made so as to have an attractive appearance and colour.

The envelope 10 comprises also a bottom 12 which, preferably, defines a very wide-mouthed spherical cap as shown in FIG. 1. This arrangement is such that the bottom 12 can bear on the ground, or on any other surface, only via its peripheral portion so as to provide a good stability without it being necessary to provide particular protrusions from said bottom 12.

The envelope is also preferably made by an injection moulding process and, in order that the injection sprue should not be apparent, there is advantageously provided a central protrusion 13 corresponding to the protrusion 9 of the container or pot, but having smaller dimensions so as to be able to be fitted within the protrusion 9 without there is a contact between their opposed walls or between the injection sprues.

Figure 2:
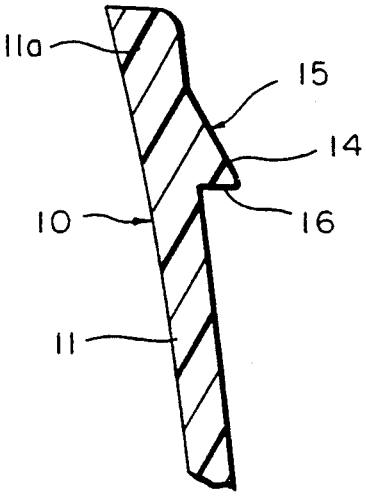
FIG. 2 is a cross-sectional view, at a larger scale, of the detail A shown in FIG. 1.

FIGS. 1 and 2 show that the side wall 11 of the envelope 10 is of a height greater than that of the container 1.

On the other hand, it is advantageous that the upper portion 11*a* of the wall 11 is made progressively thicker. The thickness of the upper edge 11*a* of the envelope 10 can be, for example, substantially equal to double of the average thickness of the wall 11 (ratio within the order of 2 to 1, as this is particularly shown in FIG. 2.

From its inner face and near its upper edge, the envelope 10 defines a peripheral flange 14 forming a ramp 15 and a shoulder 16 extending so as to be almost perpendicular to the inner wall of the envelope 10 so as to form a retaining means.

The respective diameters of the protruding flange 7 of the container or pot 1 and of the peripheral flange 14, as well as the diameter of the inner wall of the envelope 10, are chosen such that the flange 7 of the container or pot will rub strongly against the ramp 15 when the container is introduced inside the envelope 10 and when this flange 7 comes to bear snugly against the inner face of the side wall 11. This embodiment makes that the flange 16 fulfills the function of a reverse-lock abutment preventing any unintentional extraction of the envelope.

Once the container 1 is fully engaged inside the envelope 10, the top of the protruding flange 7 is spaced apart from the shoulder 16 by a measure h.

As shown in the drawings, typically the measure h is substantially equal to half a distance existing between top of the container or pot 1 and top of the envelope 10.

The measure h existing between the protruding flange 7 and the shoulder 16 is such that it is always possible to put the container in position even if roots or earth protrude beyond the bottom 2 of said container through the drainage openings 8, or if various impurities have fallen onto the bottom 12 of the envelope when the container is being put in place.

The fact that the protruding flange 7 of the container comes to bear against the inner face of the envelope 10 has for its effect to put under stress the wall of the envelope at the point of contact with the container or pot, which therefore adapt themselves to one another in the fashion of a moulded part and of a counter-moulded part.

The existence of the shoulder 16 prevents an extraction by accident of the container 1 from the envelope 10 when the container-envelope combination is lifted by gripping for example this combination via a plant having grown inside the container, which obviously is full of earth in this case.

Figure 3:
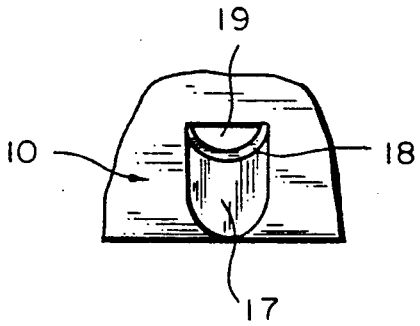
FIG. 3 is a partial elevation view substantially taken along line III—III of FIG. 1.

In addition to the preceding, the envelope 10 is formed advantageously from the bottom 12 with a notch 17 the top of which has an inclined bottom 18 in which is formed an opening 19. The hereabove disposition, quite apparent in FIGS. 2 and 3, makes that a certain quantity of water or nutritious liquid can be maintained in the bottom of the envelope 10, thereby forming a reserve without the level of this water or nutritious liquid being able to extend over that of the opening 19. The inclination of the bottom 18 has for its effect to conceal the opening 19, and this without any risk of stopping the penetration of the container or pot when put in position. Thus, it is possible to maintain a plant in a good state of health in the hereabove described combination, during the phases posterior to the cultivation, and in particular the moment of sale. Moreover, the space separating the container or pot from the envelope forms a thermal insulation avoiding abrupt variations of temperature for the earth contained therein.

A space can be provided between the bottom 12 of the envelope and the bottom 2 of the container or pot 1 so as to increase the volume of the reserve formed between the envelope bottom and the opening 19.

The invention is not limited to the embodiment shown and described in detail, since various modifications can be carried out thereto without departing from its scope as shown in the appended claims.

I claim:

1. A pot cover container-envelope combination for presentation of cultivated plants, comprising, a container or pot in which the plant has been cultivated engaged inside an envelope, said envelope having a height greater than that of said container or pot, said envelope having an upper portion, a side wall and a bottom, at least one space being provided between said container or pot and the inside of said envelope, a retaining means on said envelope for preventing any accidental disengagement of said container or pot from said envelope, said retaining means being located adjacent to and below said upper portion of said envelope and above said container or pot, and having a peripheral flange protruding inward from an inner surface of said side wall, said peripheral flange having an inner diameter which requires a protruding flange of said container or pot to rub against said peripheral flange during insertion into said envelope, said protruding flange of said container bearing against said inner side of said side wall after being fully inserted in said envelope, and wherein said peripheral flange has a ramp which facilitates introduction of said protruding flange of said container or pot.

2. The combination as set forth in claim 1, wherein a shoulder of said peripheral flange is spaced a measure h from a top rim of said container or pot when said container or pot is fully inserted in said envelope.

3. The combination as set forth in claim 1, wherein said protruding flange of said container or pot has a diameter which is slightly greater than an inner diameter of said peripheral flange of said container or pot.

4. The combination as set forth in claim 1, wherein said envelope has a notch having an opening, said notch formed up from said bottom along said side wall of said envelope.

5. The combination according to claim 1, wherein said side wall has an average thickness and said upper portion has a thickness greater than said average thickness of said side wall.

6. The combination according to claim 5, wherein said thickness of said upper portion is substantially equal to double said average thickness of said side wall.

7. The combination according to claim 1, wherein a further space is provided between said bottom of said envelope and a bottom of said container.

* * * * *